US005816305A

United States Patent [19]

May

[11] Patent Number: 5,816,305

[45] Date of Patent: Oct. 6, 1998

[54] PROTECTIVE COVER HAVING A NON-WOVEN ABSORBENT LAYER

[75] Inventor: David C. May, Durham, N.C.

[73] Assignee: D.C. Macy Corporation, Durham, N.C.

[21] Appl. No.: 576,112

[22] Filed: Dec. 21, 1995

[51] Int. Cl.[6] ..... B65D 65/02; B65D 85/00

[52] U.S. Cl. ..... 150/165; 150/166; 160/340; 442/394

[58] Field of Search ..... 150/165, 166; 160/340

[56] References Cited

U.S. PATENT DOCUMENTS

| | | | |
|---|---|---|---|
| 2,035,384 | 3/1936 | Hinchliff | 66/170 |
| 2,432,662 | 12/1947 | Gardner | 150/52 |
| 2,652,023 | 9/1953 | Kletsky | 118/505 |
| 2,711,234 | 6/1955 | Rubens | 190/26 |
| 3,022,808 | 2/1962 | Silver | 150/52 |
| 3,146,784 | 9/1964 | Silver | 135/1 |
| 3,259,173 | 7/1966 | Manning | 160/238 |
| 3,785,697 | 1/1974 | Dabbs | 296/136 |
| 3,900,631 | 8/1975 | Woodell | 428/195 |
| 4,609,580 | 9/1986 | Rockett et al. | 428/198 |
| 4,795,207 | 1/1989 | Clarke | 296/136 |
| 4,822,669 | 4/1989 | Roga | 428/287 |
| 4,951,993 | 8/1990 | Taboada | 296/136 |
| 4,958,881 | 9/1990 | Piros | 296/98 |
| 5,087,092 | 2/1992 | Antopolsky et al. | 296/95.1 |
| 5,173,346 | 12/1992 | Middleton | 428/53 |
| 5,266,390 | 11/1993 | Garland | 428/216 |
| 5,364,156 | 11/1994 | Zerow | 296/136 |
| 5,368,912 | 11/1994 | Reaves | 428/192 |
| 5,413,396 | 5/1995 | Poznansky et al. | 296/136 |
| 5,500,267 | 3/1996 | Canning . | |
| 5,572,740 | 11/1996 | Geniesse . | |

OTHER PUBLICATIONS

Fairchild's Dictionary of Textiles. ed. my Dr. Isabel Wingate, New York University. Fairchild Publications, Inc. NY 1959, p. 554.

Polymers: Fibers and Textiles, A Compendium, ed. my Kroschwitz John Wiley & Sons, New York 1990, pp. 225–226.

*Primary Examiner*—Kathleen Choi

*Attorney, Agent, or Firm*—Maginot, Addison & Moore

[57] ABSTRACT

A method of protecting an object during application of a fluid onto a surface. The method includes the following steps, (1) providing a cover having a first layer and a second layer attached together, the first layer including a non-woven fabric material and the second layer including a plastic material, and (2) positioning the cover relative to the object so that the fluid is prevented from contacting the object during application of the fluid onto the surface. A drop cloth having a first layer which includes a non-woven fabric material, and a second layer which includes a plastic material, is also disclosed.

1 Claim, 3 Drawing Sheets

PROTECTIVE COVER HAVING A NON-WOVEN ABSORBENT LAYER

BACKGROUND OF THE INVENTION

The present invention generally relates to a method and apparatus for protecting an object, surface, or the like. The present invention particularly relates to a protective cover having a plurality of layers. The present invention more particularly relates to a protective cover having a non-woven absorbent layer.

Protective covers, such as drop cloths, are used in conjunction with activities which may result in damage to objects in the environment where the activity is taking place. For example, the surface of walkways, patios, decks, carpet, and furniture needs to be protected when applying fluid products, such as paint, paint products, cleaners, varnish or wall-paper paste to nearby surfaces.

Heretofore, drop cloths have been made from sheets of cotton, cotton blended fabrics, paper, paper-plastic combinations, or plastic which are draped, or otherwise placed around the objects requiring protection from fluid spatterings. While prior art drop cloths afford a certain amount of protection they do have certain disadvantages.

Cotton or cloth-based drop cloths tend to be permeable to certain types of fluid, thereby allowing the fluid to pass through and contact the surface to be protected. Moreover, these types of drop cloths tend to be relatively heavy and cumbersome to handle.

Drop cloths made from sheets or films of plastic do not absorb some fluids well, particularly water based paints. As a result of their poor absorption characteristics, spilled fluids form slippery and slow drying wet spots thereby creating a hazard to the user. Moreover, the fluid forming these wet spots can come in contact with the soles of shoes and be tracked to other surfaces. An additional disadvantage is that drop cloths constructed from substrates including non-permeable plastic films or sheets are not as flexible as fabric and therefore do not drape well around the objects to be protected. Thin plastic drop cloths have better draping characteristics but are prone to ripping and tearing and therefore are not suited for covering abrasive objects such as concrete or brick.

Drop cloths made from a sheet or film of plastic attached to a sheet of paper, to a large degree, suffer from the same disadvantages as discussed above with reference to plastic sheet drop cloths. That is, sheets of plastic-paper combinations are relatively inflexible, and do not possess absorption characteristics that effectively inhibit the formation of the aforementioned wet spots. As a result, these types of drop cloths do not drape well, and their use increases the chances that the fluid forming the wet spots will be tracked to other surfaces. An additional problem with these types of drop cloths is that the paper sheet is prone to tearing, or tends to separate from the attached plastic backing. These last two problems can become even worse when the paper sheet comes into contact with a fluid.

In light of the above discussion, it is apparent that a light-weight, absorbent, tear resistant, highly drapable protective cover would be desirable. The present invention provides such a protective cover. The cover of the present invention includes a layer of plastic material attached to a layer of non-woven fabric material. The non-woven fabric material being made from fibers randomly interlocked to form a web or mat. Relative to prior art drop cloths formed from sheets or films of materials, such as paper or plastic, the cover of the present invention has a large permeable surface area resulting from the large number of intertwined individual fibers used to form the non-woven layer. One advantage of having a layer made from individual non-woven fibers is that spilled liquids are quickly absorbed and dispersed throughout the fiber matrix. Moreover, once absorbed, the liquids are retained in the non-woven layer where they quickly dry out, thereby minimizing any chance that they will be tracked to other surfaces.

Another advantage of the present invention is that the fibers used to form the non-woven layer are light-weight, flexible, and capable of withstanding significant tensile forces. Therefore, the protective cover of the present invention is also light-weight, resistant to tearing or puncturing, and is highly drapable.

SUMMARY OF THE INVENTION

In accordance with one embodiment of the present invention, there is provided a method of protecting an object during application of a fluid onto a surface. The method includes the following steps, (1) providing a cover having a first layer and a second layer attached together, the first layer including a non-woven fabric material and the second layer including a plastic material, and (2) positioning the cover relative to the object so that the fluid is prevented from contacting the object during application of the fluid onto the surface.

Pursuant to another embodiment of the present invention, there is provided a method of protecting an object during application of a paint product onto a surface. The method includes the following steps, (1) providing a drop cloth having a first layer and a second layer attached together, the first layer including a non-woven fabric material and the second layer including a plastic material, and (2) positioning the drop cloth relative to the object so that the paint product is prevented from contacting the object during application of the paint product onto the surface.

According to yet another embodiment of the present invention, there is provided a drop cloth. The drop cloth includes a first layer having a non-woven fabric material, the first layer having a thickness in the range of 1 to 2 mils. The drop cloth also includes a second layer attached to the first layer, the second layer having a plastic material.

According to still another embodiment of the present invention, there is provided a drop cloth. The drop cloth includes a first layer having a non-woven fabric material, and a second layer attached to the first layer. The second layer having a plastic material. The drop cloth also includes a third layer having a non-woven fabric material attached to the second layer so that the second layer is interposed between the first and third layers.

It is therefore an object of the present invention to provide a new and useful method of protecting a surface from a fluid such as a paint product.

It is moreover an object of the present invention to provide an improved method of protecting a surface from a fluid such as a paint product.

It is still another object of the present invention to provide a new and useful drop cloth for protecting a surface.

It is also the object of the present invention to provide an improved drop cloth for protecting a surface.

It is yet another object of the present invention to provide a tear resistant cover which is light-weight and highly drapable.

It is still another object of the present invention to provide a cover which absorbs and retains liquids while simultaneously providing a liquid-impervious barrier to objects positioned under the cover.

The above and other objects, features, and advantages of the present invention will become apparent from the following description and attached drawings.

DETAILED DESCRIPTION OF THE PREFERRED EMBODIMENT

Figure 1:
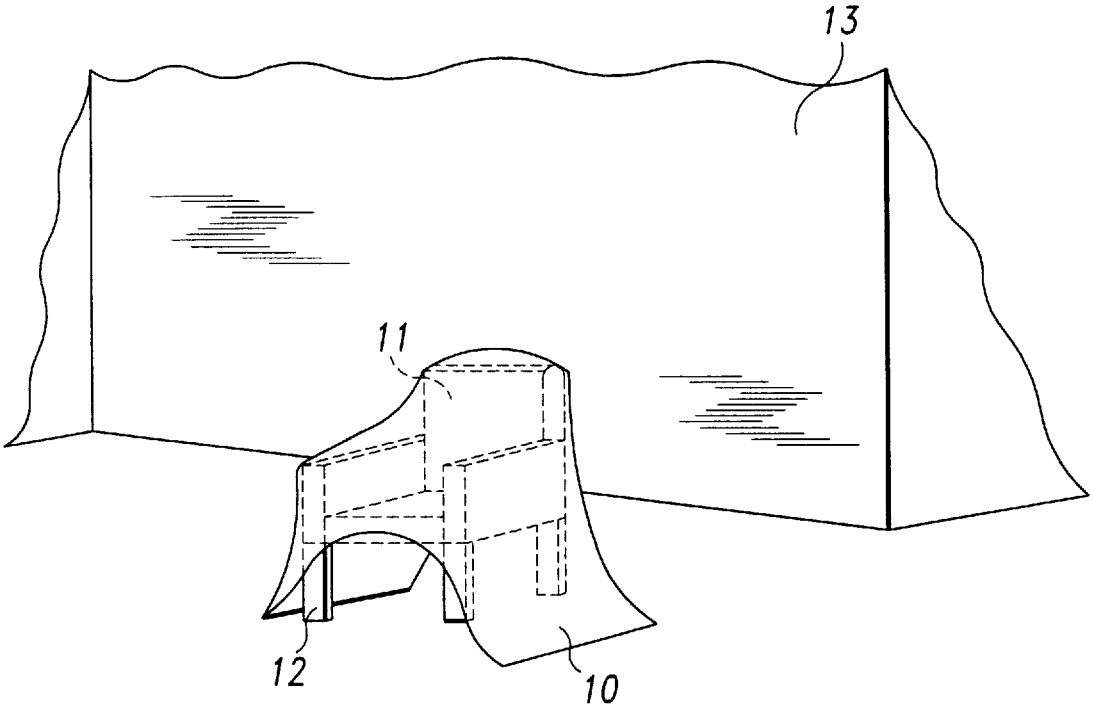
FIG. 1 is a perspective view of a chair covered with a protective cover which incorporates the features of the present invention therein.

While the invention is susceptible to various modifications and alternative forms, a specific embodiment thereof has been shown by way of example in the drawings and will herein be described in detail. It should be understood, however, that there is no intent to limit the invention to the particular form disclosed, but on the contrary, the intention is to cover all modifications, equivalents, and alternatives falling within the spirit and scope of the invention as defined by the appended claims.

Referring now to FIG. 1, there is shown a protective cover or drop cloth 10 which incorporates the features of the present invention therein. The drop cloth 10 is shown draped over or covering a chair 12 having a first surface 11. The drop cloth 10 is placed in such a position so as to protect first surface 11 from coming into contact with fluid being applied onto a second surface 13 such as a wall. The fluid can be applied to second surface 13 by methods such as brushing it on, spraying, rolling, wiping it on with a cloth, by electrostatically depositing it on, or similar methods. Any fluid dripping, splashing, spilling, or the like, off of or around, second surface 13 will contact drop cloth 10 rather than chair 12 thereby protecting first surface 11. However, it should be appreciated that drop cloth 10 can be used to cover, and thus protect, any other type of object or surface such as sidewalks, decks, bushes, driveways, hardwood floors, carpet and vinyl flooring and the like. The cover 10 of this invention is particularly suitable for protecting such surfaces and objects from paint products such as paint, primer paints, stains, paint thinners, wall paper glue, cleaning solutions, solvents and the like.

Figure 2:
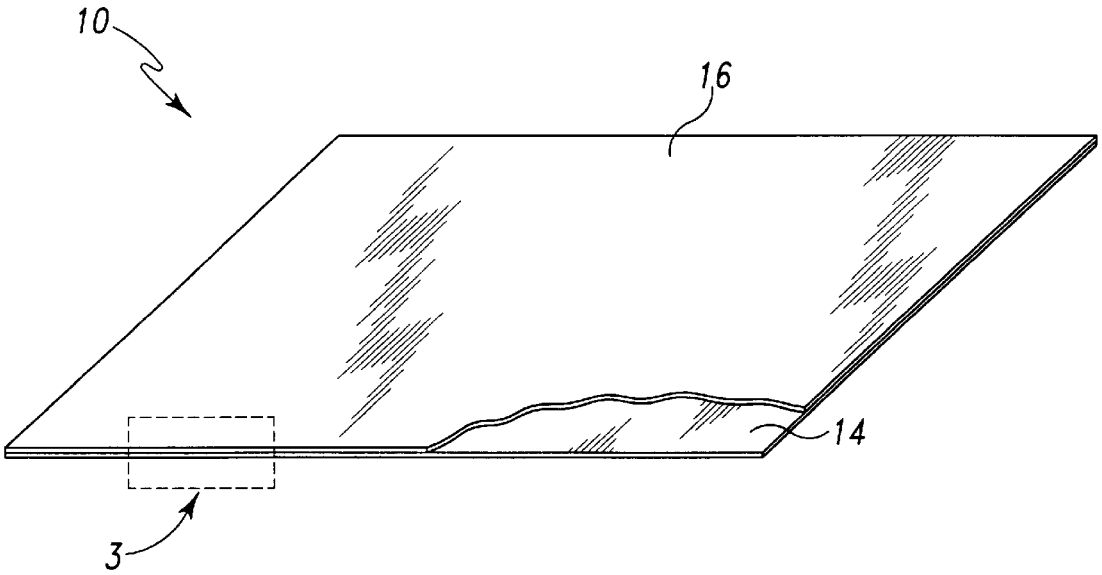
FIG. 2 is a perspective view of the protective cover shown in FIG. 1.
Figure 3:
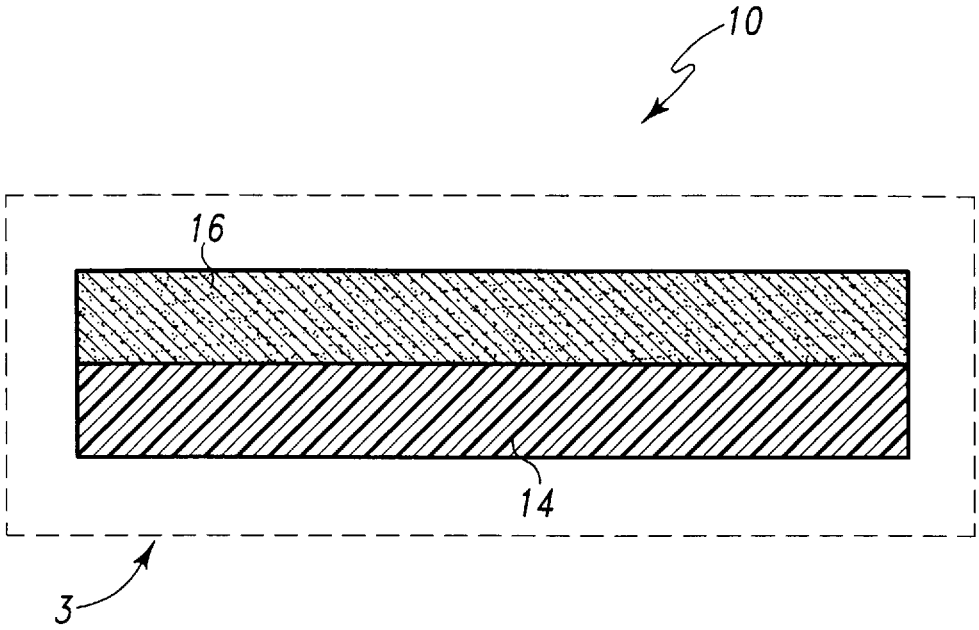
FIG. 3 is an enlarged end view of a portion 3 of the protective cover shown in FIG. 2.

As shown in FIGS. 2 and 3, the drop cloth 10 includes a bottom layer 14, and a top layer 16 joined to the bottom layer 14. In the embodiment being described, the bottom layer 14 is formed from a liquid impervious and/or solvent-resistant plastic material such as polyethylene. Alternatively, the bottom layer 14 may be formed from any other liquid impervious plastic materials such as vinyl plastics or polypropylene.

Drop cloth 10 is positioned so that bottom layer 14 is facing the surface to be protected such as surface 11 of chair 12 as shown in FIG. 1. It should be appreciated that bottom layer 14 may be treated to resist slipping across or moving relative to surface 11. One such treatment is to have a layer of adhesive material disposed on bottom layer 14 that facilitates the temporary attachment of bottom layer 14 to surface 11 of chair 12. Preferably, the adhesive material disposed on bottom layer 14 should be adapted so that drop cloth 10 can be repeatedly removed and reattached to surface 11 without disposing additional adhesive material on bottom layer 14. Such an adhesive layer on bottom layer 14 helps drop cloth 10 remain in a stationary position relative to the chair 12 while it is being protected. Moreover, having an adhesive layer disposed on bottom layer 14 and placing bottom layer 14 in contact with carpeting or a floor, would reduce slipping of drop cloth 10 across the carpeting or the floor; especially when the user walks across drop cloth 10.

Figure 4:
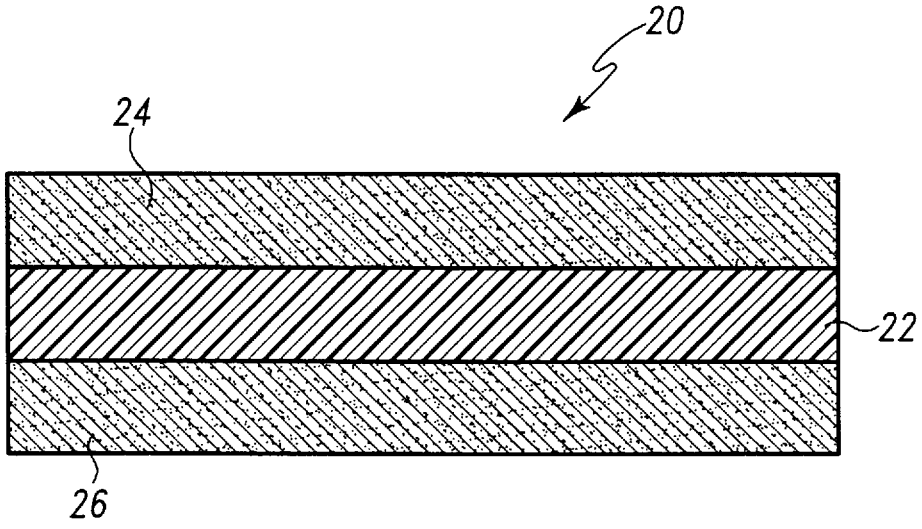
FIG. 4 is an enlarged fragmentary end view of a second embodiment of the present invention.

FIG. 4 shows a drop cloth 20 which incorporates a second embodiment of the present invention. In particular, drop cloth 20 includes a first layer 22, a second layer 24 joined to the first layer 22, and a third layer 26 attached to the first layer 22 such that first layer 22 is interposed between second layer 24 and third layer 26. As will be discussed below, one advantage of adding third layer 26 is that it imparts additional tear or puncture resistance to drop cloth 20.

It should be noted that the following discussion relates to the arrangement of layers as disclosed in reference to drop cloth 10 as shown in FIG. 2 and 3. However, it should be appreciated that all of the attributes and characteristics discussed below regarding drop cloth 10 also apply to drop cloth 20 (see FIG. 4). Since top layer 16 of drop cloth 10 is made of the same material as second layer 24 and third layer 26 of drop cloth 20, and bottom layer 14 of drop cloth 10 is made of the same material as first layer 22 of drop cloth 20.

There are two important characteristics provided by the bottom layer 14. Since bottom layer 14 is liquid impervious, liquids that initially come into contact with the top layer 16 of drop cloth 10 are prevented from coming into contact with and thus potentially damaging the underlying object or surface such as surface 11 of chair 12 as shown in FIG. 1. Since bottom layer 14 is also solvent-resistant, solvents (organic, aqueous, etc.) and paints (oil, water-based), which could potentially degrade the bottom layer 14 while being retained in the top layer 16 for an extended period of time are prevented from coming into substantial contact with and thus potentially damaging the underlying object or surface.

The top layer 16 is formed from a non-woven fabric. What is meant herein by the use of the term "non-woven fabric" means any assembly of synthetic fibers randomly interlocked and/or held together to form a web or mat, or any assembly of natural fibers randomly interlocked and/or held together to form a web or mat. In addition, the term "non-woven fabric" includes an assembly having a mixture of fibers chosen from the group of mixtures consisting of (1) synthetic fibers and natural fibers, (2) synthetic fibers and paper fibers, and (3) natural fibers and paper fibers, randomly interlocked and/or held together in a web or mat. The fibers of a non-woven assembly can be held together by mechanical interlocking, by fusing the fibers together, by bonding the fibers together with a cementing medium such as starch, glue, casein, rubber latex, or a cellulose derivative or synthetic resin, or by a combination of these techniques.

It should be noted that the aforementioned random characteristic of the non-woven fabric material describes the manner in which the fibers of the fabric material are bound or connected together. However, it should be appreciated that the fibers of the non-woven material can be oriented in any manner, including a predetermined orientation. For example, the fibers of the non-woven material may be oriented in a unidirectional orientation (fibers are predominantly oriented in the machine direction), or a crosslaid orientation (fibers are predominantly oriented in the crosslaid direction). The fibers can also be oriented in a random orientation.

Synthetic fibers used to make the non-woven fabric of the present invention are herein defined to include: (1) any thermoplastic or thermosetting fiber or any fiber formed when a solid substance is first changed to a liquid, and then converted back into a solid form again to produce a fiber, (2) any regenerated fiber, such as rayon, made from chemically treated cellulose, where the cellulose is treated with known chemicals to yield a viscous solution, and then forced through the holes of a spinneret where it solidifies to yield a fiber, (3) any spun bonded or melt blown fibers, or (4) any fiber or spinnable fiber produced by any extrusion molding technique including the following extrusion molding techniques: (1) a dry spinning extrusion molding technique where a polymer solution in a solvent is forced through tiny holes into warm air, where the solvent evaporates in the warm air, and the liquid stream solidifies into a continuous filament, (2) a wet spinning extrusion molding technique where a polymer solution is forced through tiny holes into another solution where it is coagulated into a continuous filament, and (3) a melt spinning extrusion molding technique where a solid polymer is melted and forced through tiny holes into cool air which solidifies it into a continuous filament. The above definition of synthetic fibers includes rayon fibers, acetate fibers, polyamide fibers, polyester fibers, acrylic fibers, polyvinyl fibers, spandex fibers and olefin fibers such as polyethylene and polypropylene fibers. Polyester and/or rayon fibers are particularly suited for forming the non-woven fabric of the present invention.

As previously discussed, "non-woven fabric" material can be formed from any assembly of natural fibers randomly held together in a web or mat. What is meant herein by the term "natural fibers" is (1) any protein based fiber such as wool, (2) any cotton fiber, (3) any of the agave fibers, or (4) any fiber obtained from the stalks of plants botanically known as *Corchorus capsularis* and/or *Corchorus olitorius* (also known as bast fibers). The bast fibers include jute fibers, flax fibers, linen fibers, hemp fibers, ramie fibers, sunn fibers, kenaf fibers, and urena fibers. Preferably, fibers used to produce the non-woven fabric material of the present invention are equal to or greater than 0.5 inches long.

It should be noted that the definition of natural fibers as used herein does not include paper fibers. Therefore, the definition of a "non-woven fabric" as used herein does not include an assembly consisting of only paper fibers which are randomly held together in a web or mat. Such an assembly of paper fibers generally has poor fluid absorption characteristics as compared to the "non-woven fabrics" used in the present invention. Therefore, fluids spilled on assemblies or sheets of only paper fibers (whether or not used in combination with a plastic layer) form slow drying wet spots, and these wet spots increase the likelihood that the spilled fluid will be tracked to other surfaces. Moreover, sheets consisting of only paper fibers are typically not as drapable or tear resistant as the "non-woven fabrics" contemplated by the present invention. However, it should be appreciated that mixtures of (1) natural fibers and paper fibers, or (2) synthetic fibers and paper fibers, are included in the definition of a "non-woven fabric" material. This is due to the inherent characteristics of "synthetic fibers" and "natural fibers" included in the aforementioned mixtures.

The non-woven layer of the present invention preferably has a thickness in the range of 1 to 2 mils. The advantage of having a non-woven layer in the aforementioned thickness range is that the layer is thick enough to absorb and laterally disperse fluid it comes into contact with, but remains pliable enough to be very drapable.

The non-woven fabric of the present invention can be produced by any manufacturing system including: (1) the dry laid system, (2) the wet laid system, or (3) the polymer laid system. With the dry laid system, the fabric structure is formed by having the fibers manipulated while in a dry state. The two different methods which can be used in the dry laid system include (a) the air laid method (web formed by manipulating fibers by air) and (b) the carded method (web formed by a carding machine). With the wet laid system, the fabric structure is formed by having the fibers in liquid environment and then removing the liquid once the fibers are placed onto a screen. With the polymer laid system, the fabric structure is formed by having thermoplastic fibers, upon being extruded, blown by a gas onto a collection surface. The methods used in the polymer laid system include the (a) continuous filament, and (b) the non-continuous filament methods. Non-woven fabrics suitable for use in the present invention are commercially available from Freudenberg Nonwoven Inc. located in Chelmsford, Mass. One such non-woven fabric product available from Freudenberg is known as product no. D.C. 1000.

The non-woven top layer 16 can include individual fiber filaments which may be heat fused together by using known manufacturing techniques which relate to the temperature and pressure of the process. Alternatively, fiber filaments of the non-woven fabric may be mechanically linked together, or linked together using known chemical bonding processes.

The inherent characteristics of the non-woven fibers forming the top layer 16 imparts certain desirable characteristics to drop cloth 10. These characteristics include; (1) allowing the drop cloth 10 to "stretch" before tearing or being punctured if it is pulled over a sharp surface, or if a shearing force is applied by an object (i.e. ladder, shoe) that is placed on or dragged across the drop cloth 10, and (2) the top layer 16 (and therefore the drop cloth 10) advantageously exhibits high drapability properties. That is, unlike some prior art drop cloths having sheet or film layers, the drop cloth 10, when covering an object such as the chair 12, substantially conforms to the dimensions and/or contours of the object, thus improving the protective properties of the drop cloth.

Furthermore, the absorbent fibers forming, and the three dimensional structure of, the non-woven top layer 16 permit the top layer 16 to quickly retain liquids that contact the top layer 16, and then disperse the liquid laterally across the top layer 16. Therefore, liquids that are retained in the top layer 16 quickly evaporate or dry out because of the absorbent and dispersing nature of the top layer 16. These characteristics of the top layer 16 advantageously permit the drop cloth 10 to resist sticking to an object, such as a shoe sole, which can be hazardous to the user. The aforementioned characteristics also advantageously permit the drop cloth 10 to resist or minimize tracking any absorbed fluid across other surfaces when an object, such as a wheel or shoe sole, is placed on or dragged across the top layer 16.

In the embodiment being described, the bottom layer 14 is attached to the top layer 16 by fusing or hot melting the bottom layer 14 onto the top layer 16 to form the drop cloth 10. The fusing of the bottom layer 14 to the top layer 16 can be accomplished by using any suitable heat bonding technology such as by passing the superimposed top layer 16 and bottom layer 14 through a nip of a pair of opposed bonding rollers and applying an appropriate amount of heat and pressure to effect a fusion bonding of the bottom layer 14 to the top layer 16. Alternatively, the bottom layer 14 and top layer 16 may be attached with a gluing or cementing medium of the type mentioned above. However, certain adhesive compounds may be susceptible to degradation when exposed to particular liquids or solvents. Thus, the bottom layer 14 could possibly separate from the top layer

16 when such an adhesive is used. In either case, a highly drapable, light-weight yet durable, highly absorbent protective cover is formed by joining the non-woven top layer 16 with the bottom layer 14.

While the invention has been illustrated and described in detail in the drawings and foregoing description, such illustration and description is to be considered as exemplary and not restrictive in character, it being understood that only the preferred embodiments have been shown and described and that all changes and modifications that come within the spirit of the invention are desired to be protected.

What is claimed is:

1. A method of protecting an object during application of a paint product onto a surface, comprising the steps of:

providing a cover having a first layer and a second layer attached together, said first layer including a non-woven fabric material and said second layer including a plastic material;

positioning said cover relative to said object so that the paint product is prevented from contacting said object during application of the paint product onto the surface;

wherein said non-woven fabric material includes cotton fibers which are oriented relative to one another in a predetermined pattern;

wherein the second layer has a layer of adhesive material disposed thereon; and wherein the positioning step includes the step of positioning the cover so that the layer of adhesive material is interposed between the object and the second layer.

* * * * *

UNITED STATES PATENT AND TRADEMARK OFFICE

CERTIFICATE OF CORRECTION

PATENT NO. : 5,816,305
DATED : October 6, 1998
INVENTOR(S) : David C. May

It is certified that error appears in the above-identified patent and that said Letters Patent is hereby corrected as shown below:

On title page, item [73], change to read as follows:

-- D.C. May Corporation, Durham, N.C.--

Signed and Sealed this

Ninth Day of March, 1999

*Attest:*

*Attesting Officer*

Q. TODD DICKINSON

*Acting Commissioner of Patents and Trademarks*